US006748912B2

(12) United States Patent
Simpson et al.

(10) Patent No.: US 6,748,912 B2
(45) Date of Patent: Jun. 15, 2004

(54) METHOD TO VENT AIR FROM A CAM PHASER WITH A CENTER MOUNTED SPOOL VALVE

(75) Inventors: Roger Simpson, Ithaca, NY (US); Franklin R. Smith, Cortland, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/444,196

(22) Filed: May 23, 2003

(65) Prior Publication Data

US 2003/0230268 A1 Dec. 18, 2003

Related U.S. Application Data

(60) Provisional application No. 60/389,068, filed on Jun. 14, 2002.

(51) Int. Cl.[7] ..... F01L 1/34

(52) U.S. Cl. ..... 123/90.17; 123/90.15; 74/568 R

(58) Field of Search ..... 123/90.12, 90.15, 123/90.16, 90.17, 90.31; 74/568 R; 464/1, 2, 160; 92/121, 122

(56) References Cited

U.S. PATENT DOCUMENTS 6,325,031 B1 * 12/2001 Takano ..... 123/90.17
6,439,182 B1 * 8/2002 Sugiura et al. ..... 123/90.17

* cited by examiner

*Primary Examiner*—Thomas Denion
*Assistant Examiner*—Jaime Corrigan
(74) *Attorney, Agent, or Firm*—Brown & Michaels, PC; Greg Dziegielewski

(57) ABSTRACT

A variable camshaft phase adjustment device (phaser) for an internal combustion engine having at least one camshaft. The phaser has a housing having an outer circumference for accepting a drive force, and a rotor connected to a camshaft coaxially located within the housing. The housing and the rotor are capable of rotation to shift the relative angular position of the camshaft and the crankshaft. The spool valve comprising a spool slidably mounted within a bore in the rotor. In the spool a chamber is present that has an input communicating with the bore the spool is mounted in, an output communicating with the outside, and an air flow restriction. Hydraulic fluid from the input communicating with the bore is prevented from communicating with the outside by the air flow restriction. The air flow restriction is either in the input communicating with the bore or the output communicating with the outside.

12 Claims, 2 Drawing Sheets

METHOD TO VENT AIR FROM A CAM PHASER WITH A CENTER MOUNTED SPOOL VALVE

REFERENCE TO RELATED APPLICATIONS

This application claims an invention which was disclosed in Provisional Application No. 60/389,068, filed Jun. 14 2002, entitled "Method To Vent Air From A Vane Style Cam Phaser With A Center Mounted Spool Valve". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of variable camshaft timing systems. More particularly, the invention pertains to a vent mechanism for venting air out of a variable camshaft timing system.

2. Description of Related Art

Internal combustion engines have employed various mechanisms to vary the angle between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). In most cases, the phasers have a rotor with one or more vanes, mounted to the end of the camshaft, surrounded by a housing with the vane chambers into which the vanes fit. It is possible to have the vanes mounted to the rotor, and the chambers in the housing, as well. The housing's outer circumference forms the sprocket, pulley or gear accepting drive, usually from the camshaft (typically a chain, belt or gears). The phaser operates using engine oil as the working fluid, introduced into the oil chambers on either side of vanes, so as to rotate the camshaft angularly relative to the drive from the crankshaft.

Since phasers cannot be perfectly sealed they are subject to the introduction of air into the system. When air is present in phaser it can cause rattling of the vane, an inability to hold phase angle, and an overall sluggish response. In the prior art, air that is present in the system is compressed in the vane chamber by torque reversals or is allowed to leak out through seals. The prior art does not provide an effective, efficient way in which to remove air present in the phaser.

In a variable cam timing (VCT) system, the timing gear on the camshaft is replaced by a variable angle coupling known as a "phaser," having a rotor connected to the camshaft and a housing connected to (or forming) the timing gear, which allows the camshaft to rotate independently of the timing gear, within angular limits, to change the relative timing of the camshaft and crankshaft. The term "phaser," as used here, includes the housing and the rotor, and all of the parts to control the relative angular position of the housing and rotor, allowing the timing of the camshaft to be offset from the crankshaft. In any of the multiple-camshaft engines, it will be understood that there would be one phaser on each camshaft, as is known to the art.

There are three common types of phasers: Cam Torque Actuated (CTA), Oil Pressure Actuated (OPA), and Torsion or Torque Assist (TA). In a CTA phaser, the variable cam timing system uses torque reversals in the camshaft caused by the forces of opening and closing engine valves to move the vane. Control valves are present to allow fluid flow from chamber to chamber causing the vane to move, or to stop the flow of oil, locking the vane in position. The CTA phaser has oil input to make up for losses due to leakage but does not use engine oil pressure to move the phaser.

In OPA or TA phasers, the engine oil pressure is applied to one side of the vane or the other, in the retard or advance chamber, to move the vane. The TA phaser adds check valves either one in each supply line to each chamber or one in the engine oil supply line to the spool valve. The check valves block oil pressure pulses due to torque reversals from propagating back into the oil system, and stop the vane from moving backward due to torque reversals. Motion of the vane due to forward torque effects is permitted.

In all three phasers, OPA, CTA, and TA, a spool valve controls the oil that is allowed to enter and exit from the vane chambers. The spool controls the exit and entry of oil by the placement of its lands. The position of the spool is controlled by a force solenoid which may be mechanical, electrical, or variable, or a differential pressure control system (DPCS). The spool valve is influenced towards the force solenoid by a spring. The spool valve commonly is in a bore in the rotor.

SUMMARY OF THE INVENTION

A variable camshaft phase adjustment device (phaser) for an internal combustion engine having at least one camshaft. The phaser has a housing having an outer circumference for accepting a drive force, and a rotor connected to a camshaft coaxially located within the housing. The housing and the rotor are capable of rotation to shift the relative angular position of the camshaft and the crankshaft. The spool valve comprising a spool slidably mounted within a bore in the rotor. In the spool a chamber is present that has an input communicating with the bore the spool is mounted in, an output communicating with the outside, and an air flow restriction. Hydraulic fluid from the input communicating with the bore is prevented from communicating with the outside by the air flow restriction. The air flow restriction is either in the input communicating with the bore or the output communicating with the outside.

DETAILED DESCRIPTION OF THE INVENTION

Figure 1:
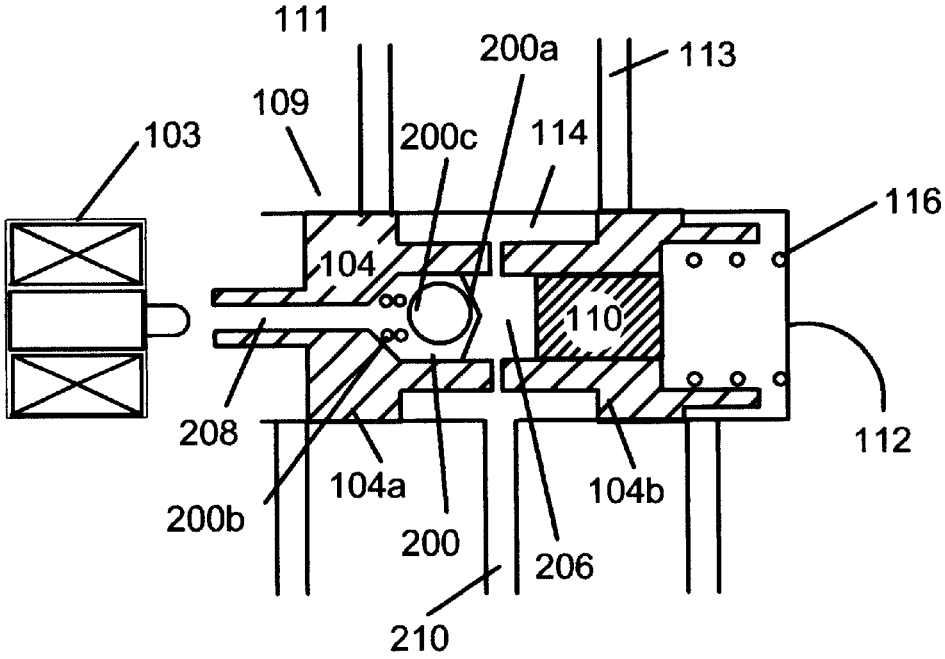
FIG. 1 shows a schematic of an air venting mechanism for venting air from a center mounted spool valve.
Figure 2:
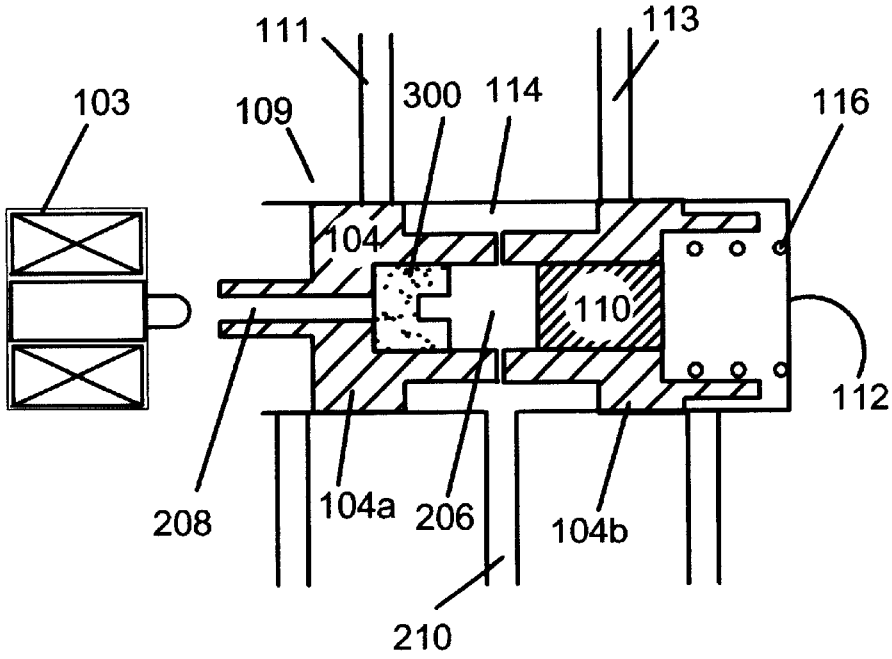
FIG. 2 shows a schematic of an alternate air venting mechanism for venting air from a center mounted spool valve.
Figure 4:
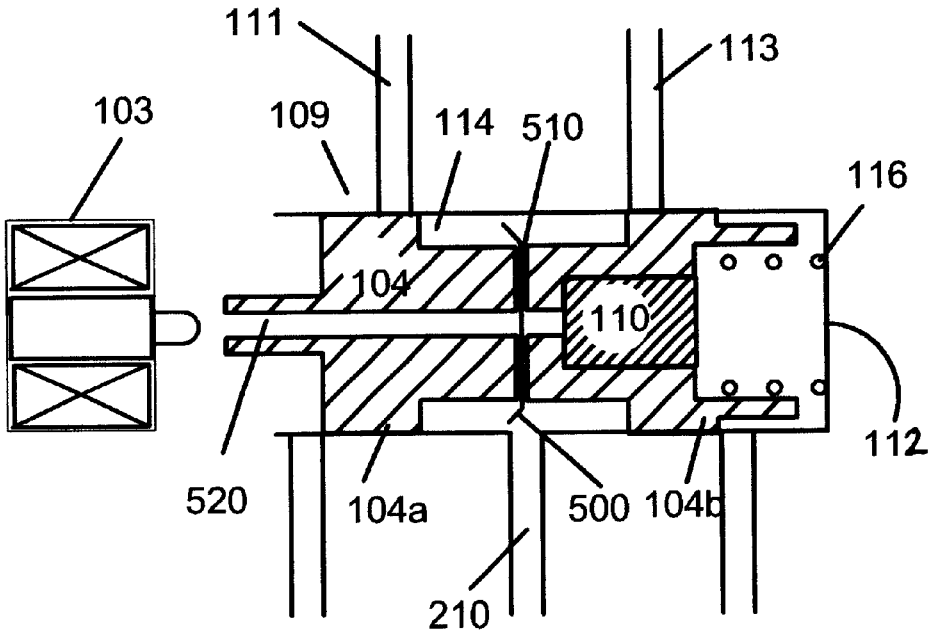
FIG. 4 shows a schematic of another alternate air venting mechanism for venting air from a center mounted spool valve.

FIG. 1 shows the spool valve of a variable cam timing phaser. The spool valve (109) is centrally located in the rotor (not shown). The spool valve (109) is made up of a cylindrical member (112) and spool (104), which is slidable to and fro. The spool (104) has cylindrical lands **(104*a*) and (104*b*) on opposed ends thereof The lands (104*a*)(104*b*) fit snugly within the member (112) and are positioned such that the lands (104*a*)(104*b*) block the entry/exit of hydraulic fluid from inlet lines (111) (113), respectively when the phaser is in null position, as shown in FIGS. 1, 2 and 4. The position of the spool relative to inlet lines (111)(113) is influenced by spring (116) and an actuator (103)**. The hydraulic fluid in the inlet lines is preferably engine oil.

Within the spool (104) a hollow central chamber (206) is present. The hollow central chamber is connected to a vent passage (208). The vent passage runs vertically from the hollow central chamber radially out. As the spool (104) spins hydraulic fluid, which is heavier than air is moved to the outer circumference of spool valve (109) to cavity (114) for example. The air present in the spool valve (109), which is lighter than the hydraulic fluid is pushed into the center chamber (206). The hydraulic fluid is introduced into the spool valve (109) by supply line (210).

Within the center chamber (206), a check valve (200) and a plug (110) are present. The plug (110) is located at the end of the center chamber, which is closest to spring (116). The plug (110) fits snugly within the central chamber (206). The check valve (200), opposite the plug (110), has an annular seat (200*a*) to permit the flow of air from the center chamber (206) to the vent passage (208) which leads outside of the variable camshaft timing system. The flow of air into the system from the vent passage (208) into the center chamber (206) is blocked by ball (200*c*), which is resiliently urged against seat (200*a*). The check valve (200) also prevents the flow of hydraulic fluid from the center chamber (206) (if any is present) to the vent passage (208). When the engine is turned off the check valve (200) is closed and prevents the flow out of the vent passage (208). When the engine is running the check valve (200) is open and significantly hinders the flow to minimize oil leakage. Therefore, the check valve (200) allows the venting or escape of air in one direction, namely air trapped in the central chamber (206) which is relieved by the vent passage (208), removing sluggishness, rattling, and any inability to maintain phase angle.

The check valve (200) preferably has an opening pressure of 2 to 3 psi less than the minimum pressure required for the operation of the locking pin of the phaser. For example, if the locking pin of the variable camshaft timing system releases at 6 psi, the opening pressure of the check valve (200) would preferably be 3 psi. The opening pressure of the check valve (200) ensures that the check valve (200) will open and vent air before the locking pin is released. Therefore, when the engine is first started, the air that is trapped in the oil galley will escape out the check valve (200) until hydraulic fluid fills the phaser and generates enough pressure to lease the locking pin.

FIG. 2 shows an alternative embodiment. In the central chamber (206) of the spool (104) a sintered metal plug (300) and plug (110) are present. The hollow central chamber (206) of the spool (104) is connected to vent passage (208), which leads to outside of the variable camshaft timing system. The plug (110) is located at the end of the center chamber (206), which is closest to spring (116). The plug (110) fits snugly within the central chamber (206). The sintered metal plug (300) of this embodiment is used in place of the check valve (200) in the previous embodiment. The sintered metal plug (300) is porous allowing air to escape through the vent passage (208). The pores of the sintered metal plug (300) are preferably small enough to significantly hinder hydraulic fluid from escaping through the sintered metal plug (300) to the vent passage (208). As the spool (104) spins, hydraulic fluid, which is heavier than air is moved to the outer circumference of spool valve (109) to cavity (114) as an example. The air present in the spool valve (109), which is lighter than the hydraulic fluid is pushed into the center chamber (206). From the center chamber (206), the air moves through the pores of the sintered metal plug (300) to the vent passage (208), where the air is vented from the variable camshaft timing system.

Figure 3:
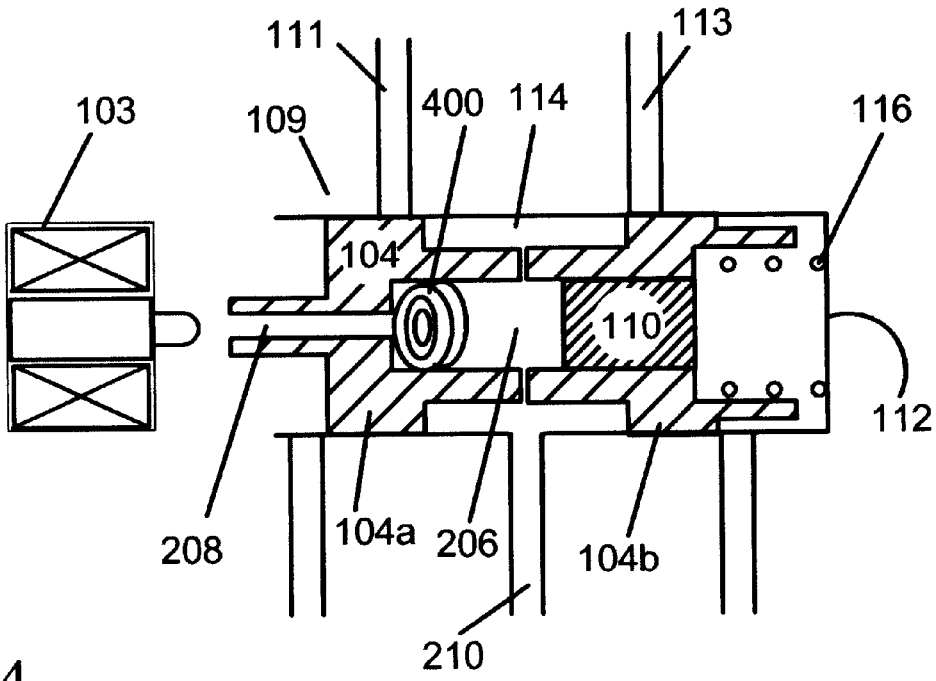
FIG. 3 shows a schematic of another air venting mechanism.

FIG. 3 shows another venting mechanism for a center mounted spool valve. The central chamber of the spool contains a tortuous path vent plug (400) and plug (110). Plug (110) is located at the end of the center chamber (206), which is closest to spring (116). The plug (110) fits snugly within the central chamber (206). Opposite plug (110) is tortuous path vent plug (400). The tortuous path vent plug (400) allows air to pass through the tortuous path vent plug (400) into the vent passage (208), and significantly hinders the flow of hydraulic fluid through the plug. The tortuous path vent plug (400) may be a barrel screw type, a plastic disk with a spiral path on the face, or other similar materials with a small path present. A schematic of the contents of the central chamber (206) are shown in FIG. 3.

As the spool (104) spins, hydraulic fluid, which is heavier than air is moved to the outer circumference of spool valve (109) to cavity (114) as an example. The air present in the spool valve (109), which is lighter than the hydraulic fluid is pushed into the center chamber (206). From the center chamber (206), the air moves through the tortuous plug (400) to the vent passage (208), where the air is vented from the variable camshaft timing system.

FIG. 4 shows another venting mechanism for a centrally mounted spool valve. The spool valve (109) is centrally located in the rotor (not shown). The spool valve (109) is made up of a cylindrical member (112) and spool (104), which is slidable to and fro. The spool (104) has cylindrical lands (104*a*) and (104*b*) on opposed ends thereof. The lands (104*a*)(104*b*) fit snugly within the member (112) and are positioned such that the lands (104*a*)(104*b*) block the entry/exit of hydraulic fluid from inlet lines (111)(113), respectively when the phaser is in null position as shown in FIG. 4. The position of the spool relative to inlet lines (111)(113) is influenced by spring (116) and force solenoid (103).

Within the center of the spool (104) is thin passage (510) that runs the entire center width of the spool (104). Running vertically through the spool valve is a vent passage (520). The vent passage (520) intersects the thin passage (510) running the center width of the spool (104). The vent passage (520) is prevented from running the entire horizontal length of the spool (104) by plug (110) which prevents the entry of hydraulic fluid into the area around spring (116). The thin passage (510) contains a wire (500) that is several thousands of an inch smaller than the diameter of the thin passage (510), in order to allow air present in the system to have a passage into the center of the spool. As the spool (104) spins, hydraulic fluid, which is heavier than air is moved to the outer circumference of spool valve (109) to cavity (114) as an example. The air present in the spool valve (109), which is lighter than the hydraulic fluid is pushed through the thin passage (510) containing the wire (500) to the vent passage (520). From the vent passage (520), the air is vented out of the system.

The figures show a schematic of an OPA or TA phaser at null position. The above embodiments may easily be applied by one skilled in the art to a CTA phaser. Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A phaser for an internal combustion engine having at least one camshaft comprising:

a housing having an outer circumference for accepting drive force;

a rotor for connection to a camshaft coaxially located within the housing and capable of rotation to shift the relative angular position of the housing and the rotor;

a spool valve comprising a spool slidably mounted within in a bore in the rotor; and a chamber having an input communicating with the bore, an output communicating with the outside, and an air flow restriction, such that hydraulic fluid from the input communicating with bore is prevented from communicating with the outside by the air flow restriction.

2. The phaser of claim 1, wherein the input communicating to the bore contains the air flow restriction.

3. The phaser of claim 2, wherein the air flow restriction is a check valve.

4. The phaser of claim 2, wherein the air flow restriction is a porous plug.

5. The phaser of claim 4, wherein the porous plug is metal.

6. The phaser of claim 4, wherein the porous plug contains pores that are substantially small in size preventing the entry of hydraulic fluid in the pores.

7. The phaser of claim 2, wherein the air flow restriction is a tortuous path vent plug.

8. The phaser of claim 7, wherein the tortuous path vent plug is a barrel screw.

9. The phaser of claim 7, wherein the tortuous path vent plug is a disk having a tortuous path on a face.

10. The phaser of claim 1, wherein the output communicating with the outside contains the air flow restriction.

11. The phaser of claim 10, wherein air flow restriction is a wiggle wire.

12. The phaser of claim 1, wherein the hydraulic fluid is engine oil.

* * * * *